US009373941B2

(12) United States Patent
Achtstätter et al.

(10) Patent No.: US 9,373,941 B2
(45) Date of Patent: Jun. 21, 2016

(54) CORONA IGNITION DEVICE

(71) Applicant: BorgWarner BERU Systems GmbH, Ludwigsburg (DE)

(72) Inventors: Tom Achtstätter, Hemmingen (DE); Timo Stifel, Korntal-Münchingen (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 169 days.

(21) Appl. No.: 14/206,695

(22) Filed: Mar. 12, 2014

(65) Prior Publication Data

US 2014/0261273 A1 Sep. 18, 2014

(30) Foreign Application Priority Data

Mar. 14, 2013 (DE) ..... 10 2013 102 592

(51) Int. Cl.

| | |
|---|---|
| ***H01T 13/14*** | (2006.01) |
| ***H01T 19/00*** | (2006.01) |
| ***H01T 13/50*** | (2006.01) |
| ***H01T 13/38*** | (2006.01) |
| ***H01T 19/04*** | (2006.01) |
| ***H01T 13/39*** | (2006.01) |

(52) U.S. Cl.

CPC ..... *H01T 13/50* (2013.01); *H01T 13/14* (2013.01); *H01T 13/38* (2013.01); *H01T 13/39* (2013.01); *H01T 19/00* (2013.01); *H01T 19/04* (2013.01)

(58) Field of Classification Search

CPC ..... H01T 13/14; H01T 13/38; H01T 13/39; H01T 19/00; H01T 19/02; H01T 19/04

USPC ..... 123/143 B, 169 E, 169 EL

See application file for complete search history.

(56) References Cited

U.S. PATENT DOCUMENTS

| | | | | |
|---|---|---|---|---|
| 5,573,733 | A * | 11/1996 | Salama | B01J 19/088 204/176 |
| 6,225,752 | B1 * | 5/2001 | Matsubara | H01T 13/38 123/169 EL |
| 2002/0167225 | A1 * | 11/2002 | Matsubara | H01T 13/467 307/10.6 |
| 2009/0322198 | A1 * | 12/2009 | Kameda | H01T 21/02 313/141 |
| 2011/0247579 | A1 | 10/2011 | Hampton et al. | |
| 2012/0055434 | A1 | 3/2012 | Giffels et al. | |
| 2013/0049566 | A1 | 2/2013 | Burrows et al. | |

FOREIGN PATENT DOCUMENTS

| | | | |
|---|---|---|---|
| DE | 10 2010 045 173 | A1 | 3/2012 |
| DE | 10 2010 045 175 | A1 | 3/2012 |
| WO | WO 2008/055483 | A1 | 5/2008 |
| WO | WO 2011/130365 | A1 | 10/2011 |

* cited by examiner

*Primary Examiner* — Erick Solis

(74) *Attorney, Agent, or Firm* — Bose McKinney & Evans LLP

(57) ABSTRACT

The invention relates to a corona ignition device for igniting fuel in a combustion chamber of an engine by means of a corona discharge, comprising a tubular housing, a coil arranged in the tubular housing, an insulator, which plugs into the tubular housing, and a center electrode, which is connected to the coil, plugs into the insulator and leads to at least one ignition tip. In order to increase the service life of the ignition tip, said ignition tip consists in part or completely of an iridium-based alloy containing 3 to 30% by weight of rhodium or is coated by a burn-up layer.

15 Claims, 3 Drawing Sheets

CORONA IGNITION DEVICE

RELATED APPLICATIONS

This application claims priority to DE 10 2013 102 592.7, filed Mar. 14, 2013, the entire disclosure of which is hereby incorporated herein by reference in its entirety.

BACKGROUND

The invention relates to a corona ignition device for igniting fuel in a combustion chamber of an engine by means of a corona discharge.

A corona ignition device for igniting fuel in a combustion chamber of an engine by means of a corona discharge is known from DE 10 2010 045 175 A1. With this corona ignition device, the center electrode carries an ignition head, which has a plurality of ignition tips and is produced by being cut out from sheet metal.

It is known from WO 2011/130365 A1 to cover the ignition tips of such an ignition head with a wear-resistant layer and to thus increase the service life of the ignition head. The wear-resistant layer is applied in the region of the ignition tips to the upper face and to the lower face of the ignition head by means of plating, powder coating or cathode ray sputtering. Platinum metals are used inter alia as material for the wear-resistant layer.

Ignition tips of corona ignition devices can also be formed as needles. DE 10 2010 045 173 A1 presents both ignition heads which, together with their ignition tips, are cut out from sheet metal, and ignition heads into which ignition tips formed by needles are plugged.

Both in the case of ignition tips cut out from sheet metal and in the case of ignition tips in the form of needles, wear is a problem.

SUMMARY

The present invention provides a way in which the service life of a corona ignition device can be extended.

With an ignition tip that consists in part or completely of an iridium-based alloy containing 3 to 30% by weight of rhodium, burn-up can be slowed and the service life thus extended. Iridium has a high melting point and a high boiling point, which result in an advantageously high resistance to burn-up. These good properties can be improved further by admixing rhodium.

Iridium-based alloys containing 3 to 10% by weight of rhodium are particularly advantageous. The iridium-based alloy preferably contains at least 80% by weight of iridium, for example 85% by weight of iridium or more. Besides iridium and rhodium, the alloy may contain further constituents, for example nickel and/or oxides. In particular, yttrium oxide, zirconium oxide, zinc oxide, cadmium oxide, indium oxide, tin oxide and lead oxide have a burn-up-reducing effect. The alloy preferably contains no more than 5% by weight of oxides, for example 0.5% by weight to 4% by weight.

The burn-up of the ignition tip can be slowed by use of an iridium-rhodium alloy. Surprisingly, a slowing of the burn-up is not absolutely necessary however to increase the service life of an ignition tip. By means of a burn-up layer, by which the ignition tip is ensheathed or is covered at least on two opposite sides, a very long service life of an ignition tip can be achieved using alloys that are, per se, less resistant to wear.

It is important for correct functioning of an ignition tip for said ignition tip to remain pointed at its end. Only then can an increase of the electric field strength be produced at its end, which is essential for the ignition of a corona discharge. Burn-up of ignition tips leads in conventional ignition tips to an increasing blunting of the ignition tip and therefore over a longer or shorter period of time to a failure of the ignition tip.

A blunting of the ignition tip can be effectively prevented with a burn-up layer that is less resistant to burn-up than the ignition tip covered thereby. A corona discharge typically starts specifically from the distal end of an ignition tip, since this is where the electric field strength is greatest. Burn-up is therefore unavoidable at the end of the ignition tip. The electric field strength and therefore also the intensity of the corona discharge decrease with increasing distance from the end of the ignition tip. The corona discharge consequently causes burn-up only in a short portion at the end of the ignition tip. With increasing burn-up of the ignition tip, a corresponding portion of the burn-up layer thus always also burns away, such that a new portion of the ignition tip is continuously exposed. Even after a long period of operation of the ignition tip, a short end portion of the ignition tip is thus always exposed. The thickness of the end portion exposed continuously by burn-up thus remains constant. The ignition tip therefore does not become blunt, but always remains sufficiently pointed as a result of burn-up.

If such a burn-up layer is present, it is not absolutely necessary to use an iridium-rhodium alloy for the ignition tip. The ignition tip may then consist in part or completely of any alloy based on a metal from the platinum group.

The burn-up layer for example may encase a wire made of an alloy based on a metal from the platinum group, or, in the case of an ignition head punched out from sheet metal, may cover an upper face and lower face of the ignition tip. Here, the burn-up layer makes it possible to make the wire surrounded thereby so thin that it always ensures a pointed ignition tip and therefore high field strengths. Accordingly, a burn-up layer on the upper face and lower face of an ignition head cut out from sheet metal enables the intermediate layer, which forms the ignition tip, to be formed very thinly. This intermediate layer is exposed at the end of the ignition tip and is continuously exposed by burn-up as far as necessary. The end of the ignition tip is therefore always pointed and enables high electric field strengths.

In accordance with an advantageous refinement of this disclosure, the ignition tip without the burn-up layer has a thickness of less than 0.3 mm. For example, the ignition tip without burn-up layer may have a thickness of 0.1 mm or less. A wire that is this thin or sheet metals that are this thin can only be handled and processed with difficulty. With a burn-up layer according to this disclosure that encases such a wire or covers the upper face and the lower face of such a thin layer, a wire or a sheet metal of sufficient thickness is obtained without difficulty, however. The ignition tip and the burn-up layer together preferably have a thickness of 0.6 mm or more.

A particularly long service life is obtained if the two measures explained above are combined, that is to say if the ignition tip is produced in part or completely from an iridium-based alloy containing 3 to 30% by weight of rhodium and if a burn-up layer is additionally provided. A single one of these two features alone already results in a considerable improvement, however, to the service life. An aspect of this disclosure therefore also relates to a corona ignition device of which the ignition tip consists in part or completely of an alloy based on a metal from the platinum group and carries a burn-up layer.

Metals from the platinum group are ruthenium, rhodium, palladium, osmium, iridium and platinum. These metals are often also referred to as platinum metals.

Instead of producing the ignition tip completely from an iridium-based alloy or another platinum metal alloy, for example coating a homogeneous wire with a burn-up layer or covering the upper face and lower face of a homogeneous layer with a burn-up layer, a composite material may also be used. For example, a fibre composite material or matrix composite material can be ensheathed by a burn-up layer or covered on its upper and lower face with a burn-up layer.

The burn-up layer is made of metal, for example an alloy which consists predominantly of one or more transition metals. Iron-based alloys, nickel-based alloys and chromium-based alloys are suitable, inter alia.

The burn-up behavior of a metal alloy is determined largely, but not exclusively, by its melting point. The burn-up layer is therefore preferably made of a material that has a lower melting point than the alloy based on a metal from the platinum group, of which the ignition tip consists in part or completely.

BRIEF DESCRIPTION OF THE DRAWINGS

Further details and advantages of this disclosure will be explained on the basis of an illustrative embodiment with reference to the accompanying drawings, in which.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
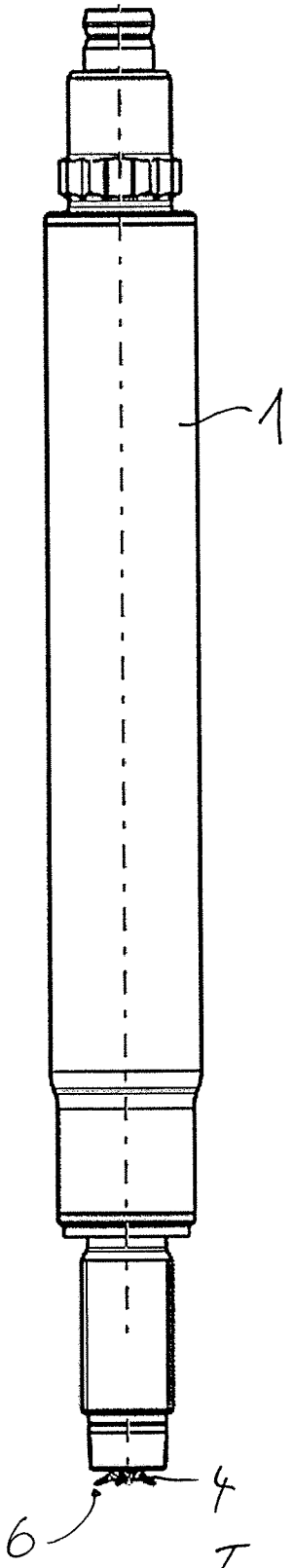
FIG. 1 shows a corona ignition device.
Figure 2:
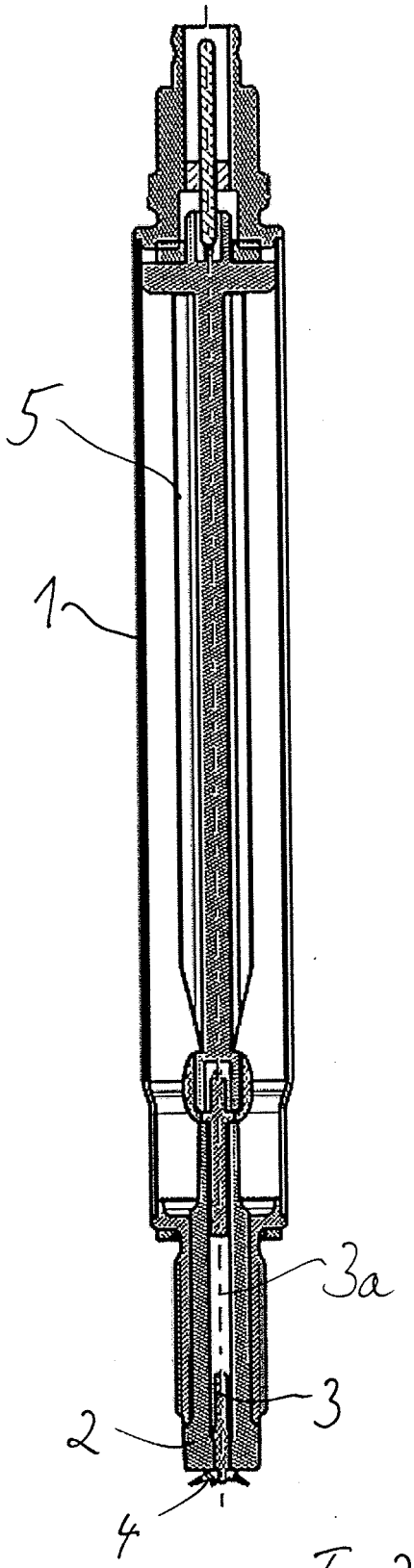
FIG. 2 shows a sectional view of FIG. 1.

The corona ignition device illustrated in FIGS. 1 and 2 generates a corona discharge for igniting fuel in a combustion chamber of an engine. The corona ignition device has a tubular housing 1, which is closed at one end by an insulator 2. A center electrode 3, which carries an ignition head 4 having a plurality of ignition tips 6, plugs into the insulator 2. A portion 3*a* of the center electrode 3 may consist of electrically conductive glass, which produces a seal.

The center electrode 3, together with the insulator 2 and the tubular housing 1, forms a capacitor, which is connected in series to a coil 5 connected to the center electrode 3. This capacitor and the coil 5 arranged in the tubular housing 1 are part of an electric oscillating circuit, the excitation of which makes it possible for corona discharges to be produced at the ignition tips 6 of the ignition head 4.

Figure 3:
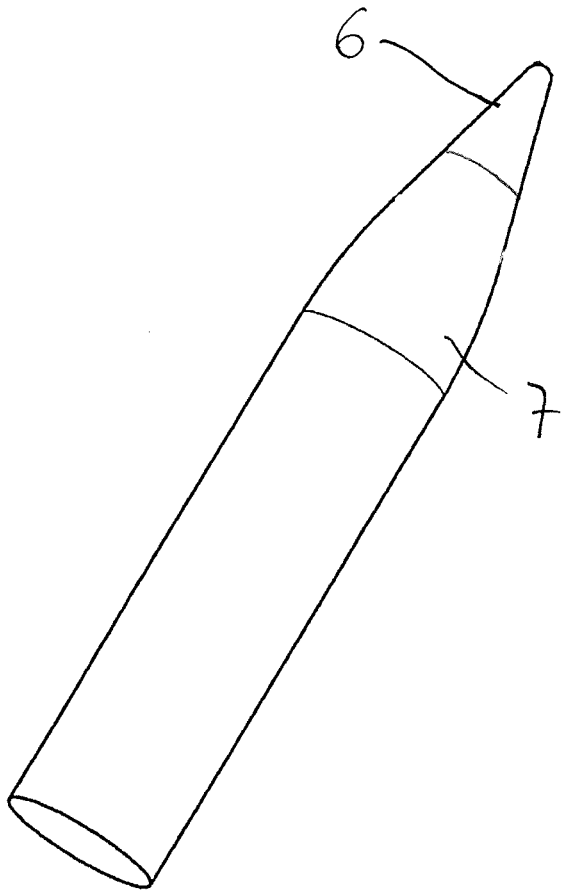
FIG. 3 shows a schematic illustration of an ignition tip of the corona ignition device.
Figure 4:
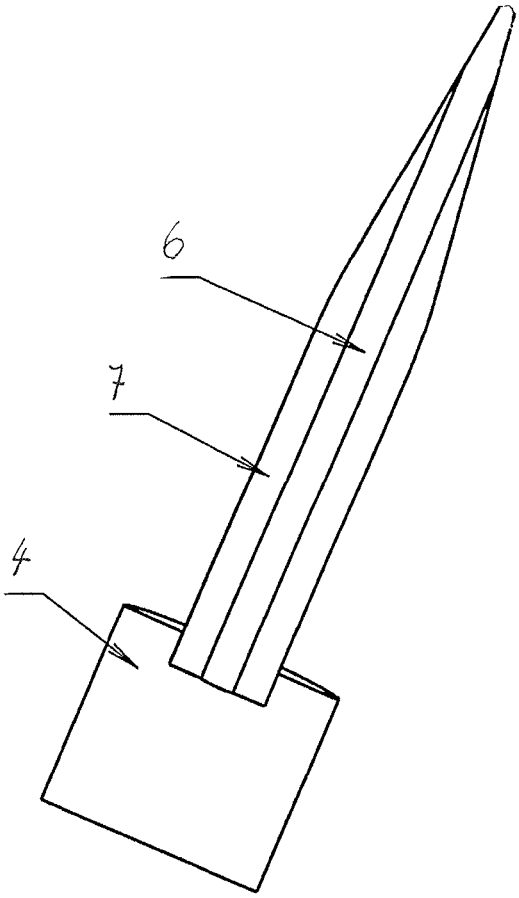
FIG. 4 shows a sectional view of the ignition tip when new.
Figure 5:
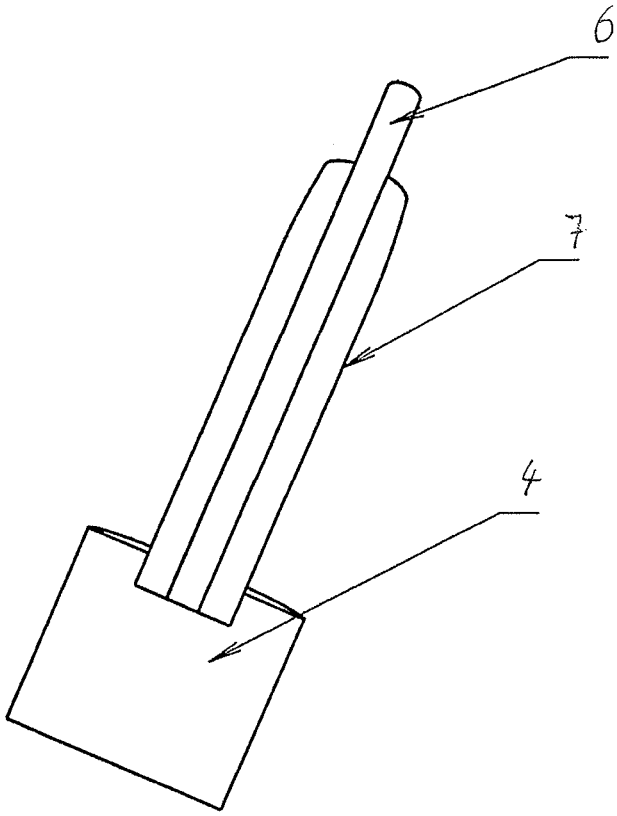
FIG. 5 shows a sectional view of the ignition tip when used.

One of the ignition tips 6 of this corona ignition device is illustrated in an enlarged manner in FIG. 3. FIG. 4 shows a longitudinal section of this ignition tip 6 in the unused, new state together with a portion of the ignition head 4 in which it is plugged. FIG. 5 shows a longitudinal section of the ignition tip 6 in the used state, that is to say with the onset of burn-up.

The ignition tip in the illustrated embodiment is a wire made of an iridium-based alloy and is ensheathed by a burn-up layer 7, which is less resistant to burn-up than the ignition tip 6. The wire that is surrounded by the burn-up layer 7 may be homogeneous, that is to say may consist completely of the iridium-based alloy. It is also possible for the wire to be a composite material that is coated by a burn-up layer 7.

At its distal end, the ignition tip 6 protrudes from the burn-up layer 7. During operation of the corona ignition device, there is thus a severe increase in the electric field strength at the distal end of the ignition tip 6. The formation of a corona discharge is thus facilitated. Such a corona discharge starts from the distal end of the ignition tip 6. The distal end of the ignition tip 6 is therefore exposed to the strongest stresses. With increasing distance from the distal end of the ignition tip 6, the electric field strength and therefore also the intensity of the corona discharge decrease.

If the burn-up layer 7 is less resistant to burn-up than the iridium-based alloy, it cannot withstand the effect of a corona discharge as well as the ignition tip 6. As a result, the burn-up layer 7 is burned away relatively quickly in an end portion of the ignition tip 6 under the effect of the corona discharge. At a greater distance from the distal end of the ignition tip 6, the intensity of the corona discharge is so low however that there is no longer any significant burn-up there. From the new state shown in FIGS. 3 and 4, the ignition tip 6 therefore transitions relatively soon into the used state illustrated in FIG. 5. In the used state too, which is characterised by burn-up of the ignition tip 6 and of the burn-up layer 7, an exposed portion of the ignition tip 6 is always present. Since the ignition tip 6 is very thin, for example has a thickness of less than 0.3 millimeters, the distal end of the ignition tip 6 is so pointed, even in the used state, that a strong increase in the electric field strength occurs and forms a corona discharge without difficulty. Due to continued operation and continued burn-up, the ignition tip 6 is indeed shorter on the whole, but the shape of its distal end remains largely unchanged, with the result that good preconditions for forming a corona discharge are furthermore provided.

In the illustrated embodiment, the ignition tip 6 has a thickness of no more than 0.1 mm. A wire that is so thin can only be handled easily because of the burn-up layer surrounding it. The burn-up layer 7 may have a thickness from 0.2 mm to 0.4 mm, for example. Without a burn-up layer 7 encasing the ignition tip 6, such a thin ignition tip 6 could only be fastened to the ignition head 4 of a corona ignition device with a great deal of effort. The ignition tip 6 together with the burn-up layer preferably has a thickness of 0.6 mm or more.

The ignition tip 6 consists in the illustrated embodiment of an iridium-based alloy containing 3 to 30% by weight of rhodium, for example 3 to 10% by weight of rhodium. The iridium proportion of the iridium-based alloy is more than 85%. The iridium-based alloy may additionally contain alloy constituents, for example nickel and/or oxides. For example, proportions from 0.5% by weight to 5% by weight of an oxide, for example yttrium oxide, zirconium oxide, tin oxide or other oxides, are favorable.

The burn-up layer 7 preferably has a lower melting point than the iridium-based alloy used for the ignition tip 6. The metal burn-up layer 7, for example, may be an alloy based on one or more transition metals. For example, nickel-based alloys, chromium-based alloys or iron-based alloys are well suited.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A corona ignition device for igniting fuel in a combustion chamber of an engine by means of a corona discharge, the corona ignition device comprising:

a tubular housing;

a coil arranged in the tubular housing;

an insulator plugged into the tubular housing;

a center electrode connected to the coil and plugged into the insulator, the center electrode leading to at least one ignition tip; and a burn-up layer by which the ignition tip is ensheathed or is covered at least on two opposite sides;

wherein the ignition tip comprises an iridium-based alloy containing 3 to 30% by weight of rhodium.

2. The corona ignition device according to claim 1, wherein the burn-up layer consists substantially of one or more transition metals.

3. The corona ignition device according to claim 1, wherein the center electrode leads to an ignition head which is made of sheet metal and which has a plurality of ignition tips.

4. The corona ignition device according to claim 1, wherein the ignition tip is made of wire.

5. The corona ignition device according to claim 1, wherein the burn-up layer comprises a nickel-based alloy, chromium-based alloy or an iron-based alloy.

6. The corona ignition device according to claim 1, wherein the ignition tip without the burn-up layer has a thickness of less than 0.3 mm.

7. The corona ignition device according to claim 1, wherein the ignition tip is formed of a composite material that contains the iridium-based alloy and an alloy consisting substantially of one or more transition metals.

8. The corona ignition device according to claim 1, wherein the iridium-based alloy contains 3 to 10% by weight of rhodium.

9. The corona ignition device according to claim 1, wherein the iridium-based alloy contains at least 80% by weight iridium.

10. A corona ignition device for igniting fuel in a combustion chamber of an engine by means of a corona discharge, the corona ignition device comprising:

a tubular housing;

a coil arranged in the tubular housing;

an insulator plugged into the tubular housing; and a center electrode connected to the coil and plugged into the insulator, the center electrode leading to at least one ignition tip comprising an alloy based on a metal from the platinum group; and a metal burn-up layer by which the ignition tip is ensheathed or coated on opposing sides, the metal burn-up layer being less resistant to burn-up than the ignition tip.

11. The corona ignition device of claim 10, wherein the ignition tip comprises an iridium-based alloy.

12. The corona ignition device of claim 11, wherein the iridium-based alloy contains 3 to 30% by weight of rhodium.

13. The corona ignition device of claim 10, wherein the ignition tip is made of wire.

14. The corona ignition device of claim 10, wherein the burn-up layer comprises a nickel-based alloy, chromium-based alloy or an iron-based alloy.

15. An ignition tip for a corona ignition device, comprising:

an alloy based on a metal selected from the platinum group; and a metal burn-up layer which ensheaths or coats the ignition tip on opposing sides, the metal burn-up layer being less resistant to burn up than the ignition tip.

* * * * *